US006572490B2

(12) United States Patent
Ashida

(10) Patent No.: US 6,572,490 B2
(45) Date of Patent: Jun. 3, 2003

(54) FRP GOLF CLUB SHAFT

(75) Inventor: Hiroki Ashida, Gifu (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/990,503

(22) Filed: Nov. 21, 2001

(65) Prior Publication Data

US 2002/0094881 A1 Jul. 18, 2002

(30) Foreign Application Priority Data

Nov. 24, 2000 (JP) ..... 2000-357858

(51) Int. Cl.[7] ..... A63B 53/10
(52) U.S. Cl. ..... 473/319; 473/409; 73/795
(58) Field of Search ..... 473/316–323; 428/36.3, 36.9; 264/635; 156/187–188; 73/795, 794

(56) References Cited

U.S. PATENT DOCUMENTS 5,961,395 A * 10/1999 You ..... 473/319

FOREIGN PATENT DOCUMENTS

| | | |
|---|---|---|
| JP | 06-278216 | 10/1994 |
| JP | 11-33151 | 2/1999 |
| JP | 11-342233 | 12/1999 |
| JP | 2000-14843 | 1/2000 |
| JP | 2000-148143 | 1/2000 |

* cited by examiner

*Primary Examiner*—Stephen Blau
(74) *Attorney, Agent, or Firm*—Troutman Sanders LLP; Gerald R. Boss, Esq.

(57) ABSTRACT

A golf club has a shaft made of fiber reinforced plastics. The shaft has braided layers with substantially symmetrical diagonal yarns which are positioned at orientation angles +θ, −θ from more than 0° to +10° and from less than −0° to −10° respectively, and/or from 45° to less than +90° and from −45° to more than −90° respectively, against the longitudinal axis of the shaft at at least a portion along the longitudinal direction of the shaft. The Poisson's ratio ν expressed by the ratio of lateral strain to longitudinal strain is 0.5 or less at least at the portion when load is applied to the shaft. The portion with the Poisson's ratio of 0.5 or less is preferably on the grip side, thus facilitating a swing of the club.

15 Claims, 7 Drawing Sheets

FRP GOLF CLUB SHAFT

This application claims priority to Japanese Patent Application No. 2000-357858, filed on Nov. 24, 2000.

BACKGROUND OF THE INVENTION

The present invention relates to a golf club shaft made of fiber-reinforced plastics (FRP), and in particular to a FRP golf club shaft which facilitates a swing by significantly suppressing deformation of the shaft cross section, a golf club having such a shaft, and a novel method for evaluating golf club shafts for deflection.

A golf club shaft made of fiber-reinforced plastics (hereinafter referred to as an 'FRP golf club shaft') is advantageous over a metal golf club shaft as it is lighter than metal one and is easier to accelerate a swing, thereby increasing the flying distance of a ball. Thus, the FRP golf club shaft is extensively employed.

The FRP shaft is a shaft formed of reinforcing fibers impregnated with resin. The FRP shaft includes a shaft fabricated in the sheet-rolling process (SIR shaft), a shaft fabricated in the filament-winding process (FW shaft), and a braided shaft. The S/R shaft is formed by winding unidirectional prepreg sheets made of reinforcing fibers over a mandrel. The FW shaft is formed by winding fiber bundles of reinforcing fibers (yarns) over a mandrel while reciprocating them along the longitudinal axis of the mandrel. The braided shaft is formed by braiding a plurality of fiber bundles of reinforcing fibers (yarns) or tow prepregs (or yarn prepregs) while braiding them over the mandrel to the substantially entire length of the shaft. In manufacturing any of the shafts, the reinforcing fibers may be impregnated with resin before or after winding the fibers around the mandrel.

The conventional FRP shafts, however, suffer from drawbacks in terms of deflection of the shafts during a swing as described below.

Consider the state of the shaft during a swing. The golfer causes generally rotational motion of the head of the club during a swing to hit a ball. During the swing, some possible forces are applied to the shaft, that is, (1) centrifugal force immediately before the impact, (2) inertial force caused by acceleration or deceleration of the head, and (3) impact force immediately after the impact. More specifically, the centrifugal force of (1) is 300 to 500 N which is generated immediately before the impact, when the head speed reaches 40 to 50 m/s. This force pulls the entire shaft in the centrifugal direction of the rotational motion and causes the shaft the bending deformation and tensile deformation. The inertial force of (2) originates in acceleration or deceleration of the head when the golfer rotates, twists, or translates his waist, arms, or wrists. This force applies bending or torsional moment on the shaft, thus causing its bending or torsional deformation. The impact force of (3) is conveyed from the head to the shaft immediately after the impact. This force causes various deformations of the shaft depending on the hitting point of the ball.

An analysis of the force applied to the shaft before the impact, such as the forces (1) and (2), shows that the force may be divided into (A) tensile stress and compression stress symmetrical to the neutral plane that are caused by bonding moment load on the shaft that is applied in the direction of the shaft, (B) tensile stress in the longitudinal direction that is caused by centrifugal force, and (C) shearing force caused by microscopic torsional load, which is negligibly small. The neutral plane of (A) means a virtual plane located along the longitudinal axis of the shaft upon which no tensile stress and compression stress act. Therefore, at a given position in the longitudinal direction of the shaft, deformations are created in the shaft's longitudinal direction and in the shaft's circumferential direction due to tensile stress or compression stress. Then the shaft cross section, which generally assumes a circular shape before the swing, deforms elliptically due to collapse or flattening, which sometimes affects the swing or the feeling of the club when the golfer swings it. Furthermore, since the degree of shaft's deflection is greater in case of golfers who are power hitters or who swing faster, the deflection is especially a serious problem for male professional golfers.

JP-A-11-33151 disclosed an S/R shaft, which materializes light weight and high elasticity and which prevents decreases in strength. Decreases in strength of shaft are prevented by having a high elasticity layer of circumferential fibers in which the fibers are directed in the circumference direction relative to the shaft axis. However, since the thickness of the layer of the circumferential fibers is 0.023 mm and this thickness is relatively thinner compared to that of the entire shaft, resistance against deformation of the layer, or contribution to shaft rigidity, is low. In addition, since this is the S/R shaft, junctions exist at the start of the winding of each reinforcing-fiber sheet and at a location between different sheets (or inter-layer location), which is undesirable in terms of the strength of the shaft.

JP-A-2000-14843 disclosed an S/R shaft using triaxial fabric layers as the reinforcing-fiber layers for providing different required characteristics, such as flexural rigidity, torsional rigidity, and anti-collapse rigidity along the longitudinal direction of the shaft with this shaft, the required characteristics may be satisfied by varying, along the axial direction of the shaft, at least one of following: the fiber density, type of fibers, and the physical properties of tri-directional yarns that constitute the triaxial fabric layers. In fabricating this shaft, triaxial fabric layers are partly overlapped and discontinuously wound over the mandrel along the longitudinal direction of the shaft. This makes the shaft undesirable in terms of the strength.

Conventionally, no index has been established for objectively evaluating the degree of shaft deflection, and the manufacturing of shafts has largely depended on manufacturer's experience.

The object of the present invention is to provide an FRP golf club shaft that facilitates swing by evaluating shaft deflection caused by the above-mentioned load applied to the shaft on swinging or before the impact, based on Poisson's ratio, and by suppressing deformation of the shaft cross section as best as possible.

BRIEF SUMMARY OF THE INVENTION

A golf club shaft made of fiber reinforced plastic comprising at least a portion along the longitudinal direction of the shaft which satisfies a Poisson's ratio of 0.5 or less The Poisson's ratio is expressed by the ratio of lateral strain to longitudinal strain. The longitudinal strain is the strain in the longitudinal direction of the shaft and the lateral strain is the strain in the circumferential direction of the shaft when load is applied to the shaft.

Other aspects and advantages of the invention will become apparent from the following description, taken in conjunction with the accompanying drawings, illustrating by way of example the principles of the invention.

BRIEF DESCRIPTION OF THE SEVERAL VIEWS OF THE DRAWINGS

The invention, together with objects and advantages thereof, may best be understood by reference to the following description of the presently preferred embodiments together with the accompanying drawings in which:

FIG. 4 is a graph showing the degree of deformation of a contour of the each shaft when bending moment is applied to different shafts with different Poisson's ratio ν.

DETAILED DESCRIPTION OF THE PREFERRED EMBODIMENTS

The present invention is described with referring to the preferred embodiments shown in the attached drawings.

Figure 1:
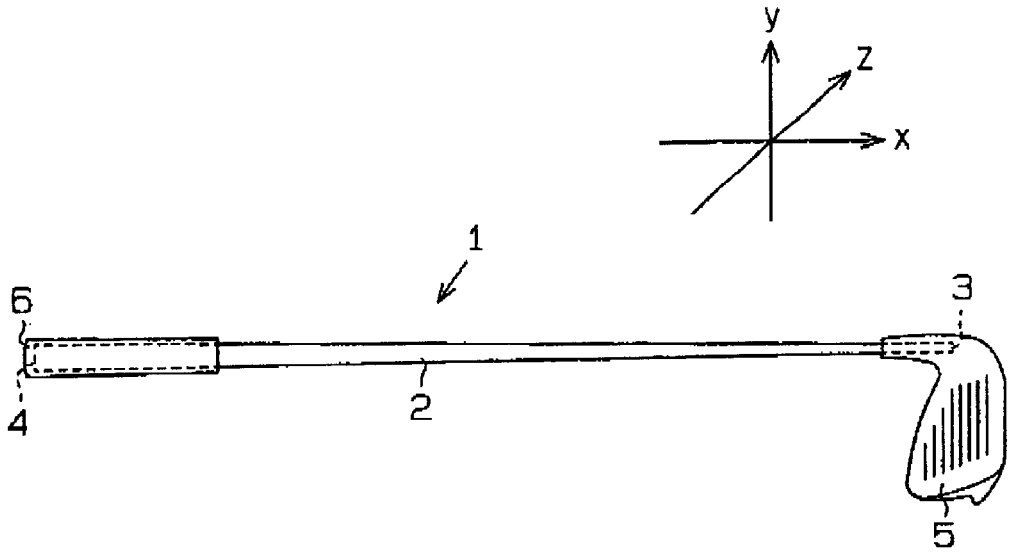
FIG. 1 is a front view of an FRP golf club having a shaft in accordance with an embodiment of the present invention.

FIG. 1 is a front view of an FRP golf club having the shaft in accordance with an embodiment of the present invention. A golf club 1 has a shaft 2 having a tip end 3 and butt end 4, a head 5 mounted on the tip end 3 of the shaft 2, and a grip 6 mounted on the butt end 4 of the shaft 2. The shaft 2 is generally tapered with its diameter decreasing from the butt end 4 toward the tip end 3.

The shaft 2 is formed of reinforcing fibers impregnated with resin matrix. The resin matrix includes thermosetting resin (such as epoxy resin, polyester resin and phenol resin) and thermoplastic resin (such as polypropylene resin, polyether ether ketone resin, ABS resin and nylon resin). The epoxy resin is particularly preferable. The reinforcing fibers include carbon fiber, polyamide fiber, glass fiber, boron fiber, alumina fiber, aramid fiber, Tyranno™ fiber, and amorphous fiber, while the carbon fiber is particularly preferable.

One of the required characteristics of the shaft 2 is the suitable rigidity for respective golfers. Excessively great rigidity will prevent a golfer from adding head speed by taking advantages of the deflection of the shaft 2, while insufficient rigidity leads to excessive flexibility of the shaft 2, which results in loss of ball control. On the other hand, it is advantageous that slight increase in the rigidity of the shaft 2 will decrease the quantity of deformation when load is applied to the shaft 2 and facilitate swing of the golf club 1. Therefore, the present invention gives an attention to the Poisson's ratio at a certain location on the longitudinal axis of the shaft 2 so that it may be utilized as an index to objectively evaluate the degree of deformation of the shaft 2. The Poisson's ratio is a specific value determined by the material and structure of the object (the shaft in this document).

First, in order to confirm whether the Poisson's ratio is related to the degree of shaft deformation, or whether the Poisson's ratio is appropriate as an index to objectively evaluate the degree of shaft deformation, a simulation to analyze the relationship between the Poisson's ratio and the quantity of deformation in the model shaft was conducted. The simulation method is described below, in which the longitudinal axis of the shaft 2 is designated as the x axis, and two axes orthogonal to the x axis are respectively designated as the y and z axes as shown in FIG. 1. Therefore, a plane parallel to the traverse cross section of the shaft 2 may be designated as a y-z plane as shown in FIG. 2B.

Figure 2A:
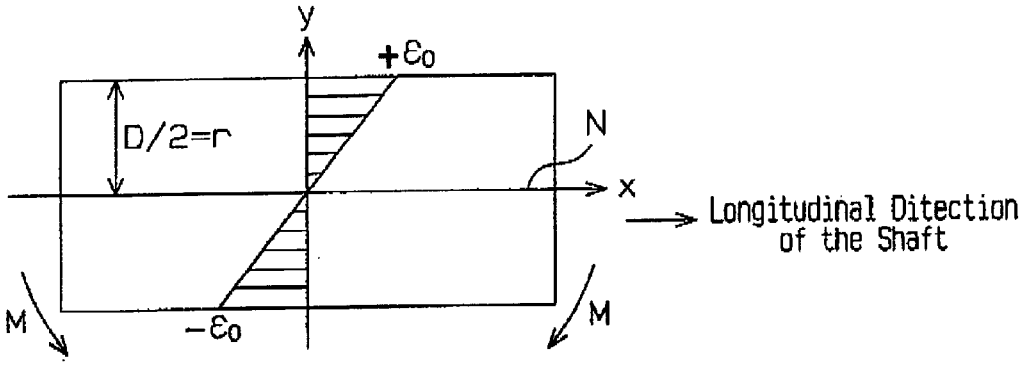
FIG. 2A is a partially enlarged longitudinal cross sectional view of a model shaft in a simulation.

FIG. 2A is a partially enlarged longitudinal cross sectional view of a model shaft provided for explaining the simulation method. The shaft is considered as a cylindrical body that has a circular cross section with the diameter D and the radius r. The neutral plane N, passing through the x axis and dividing the shaft into two, corresponds to the plane where the bending moment becomes 0 or primary moment of area becomes 0. The center coordinate ((x, y, z)=(0, 0, 0)) is defined at the intersection of the measuring point in the longitudinal direction of the shaft and the neutral plane N. The bending moment is applied in the direction indicated by the arrows M. As a result, an outward tensile stress is applied to the shaft ends at the position where y is larger than 0, while a compression stress in the longitudinal direction of the force is applied at the position where y is smaller than 0.

Figure 2B:
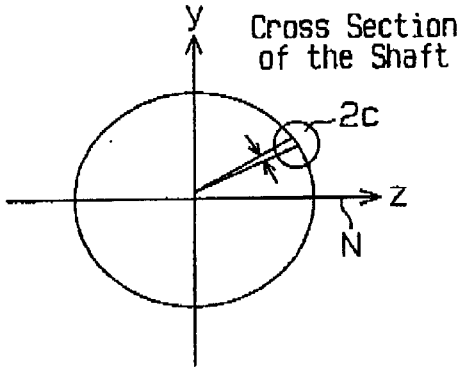
FIG. 2B is a traverse cross sectional view of the model shaft of FIG. 2A.
Figure 2C:
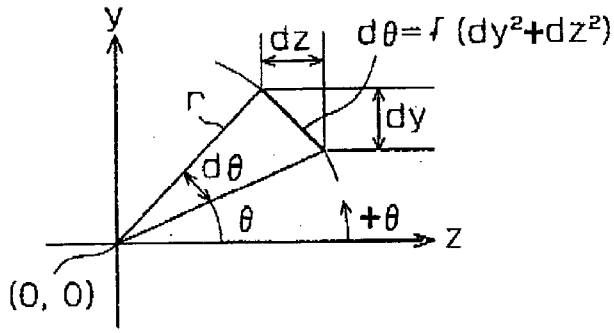
FIG. 2C is an enlarged view showing the encircled part 2*c* of FIG. 2B.

FIG. 2B is a traverse cross sectional view of the shaft at the measurement point in the longitudinal direction of the shaft in FIG. 2A. The coordinate ((y, z)=(0, 0)) is the center coordinate of the traverse cross section. FIG. 2C is an enlarged view showing the encircled part 2*c* of FIG. 2B. The area of $-\pi/2 \leqq \theta \leqq +\pi/2$ is divided into ex. 100 sectors, and the respective small sectors $d\theta=\pi/100$ will be described below.

The longitudinal strain $\epsilon X$ at the position distant y ($y=r\cdot\sin\theta$) from the neutral plane N is expressed by the equation:

$$\epsilon x=\epsilon 0\cdot y/r=\epsilon 0 \sin\theta$$

where $\epsilon 0$ is the maximum surface strain (in absolute value) against the bending moment M. When the Poisson's ratio is designated as ν, the lateral strain $\epsilon yz$, which is circumferential strain of the contour of the shaft, is expressed by $-\nu\cdot\epsilon x$.

When the bending moment is applied to circumferential small sectors $d\theta=(dy^2+dz^2)^{1/2}$, the small sectors after the deformation is expressed by $d\theta'$. The relationship below may be obtained when taking the relationship of the lateral strain $\epsilon yz$ to the longitudinal strain $\epsilon x$ into consideration.

$$(d\theta'-t-d\theta)/d\theta=\epsilon yz=-\nu\cdot\epsilon x$$

$$d\theta'-d\theta=-\nu\cdot\epsilon x\cdot d\theta$$

$$d\theta'=(-\nu\cdot x+1)\cdot d\theta$$

The degree of deformation of the shaft cross section may be expressed by integrating the quantity of deformation in the small sector $d\theta$ over the circumferential range between $-\pi/2$ and $\pi/2$ (half of the circumference of the shaft).

Figure 3:
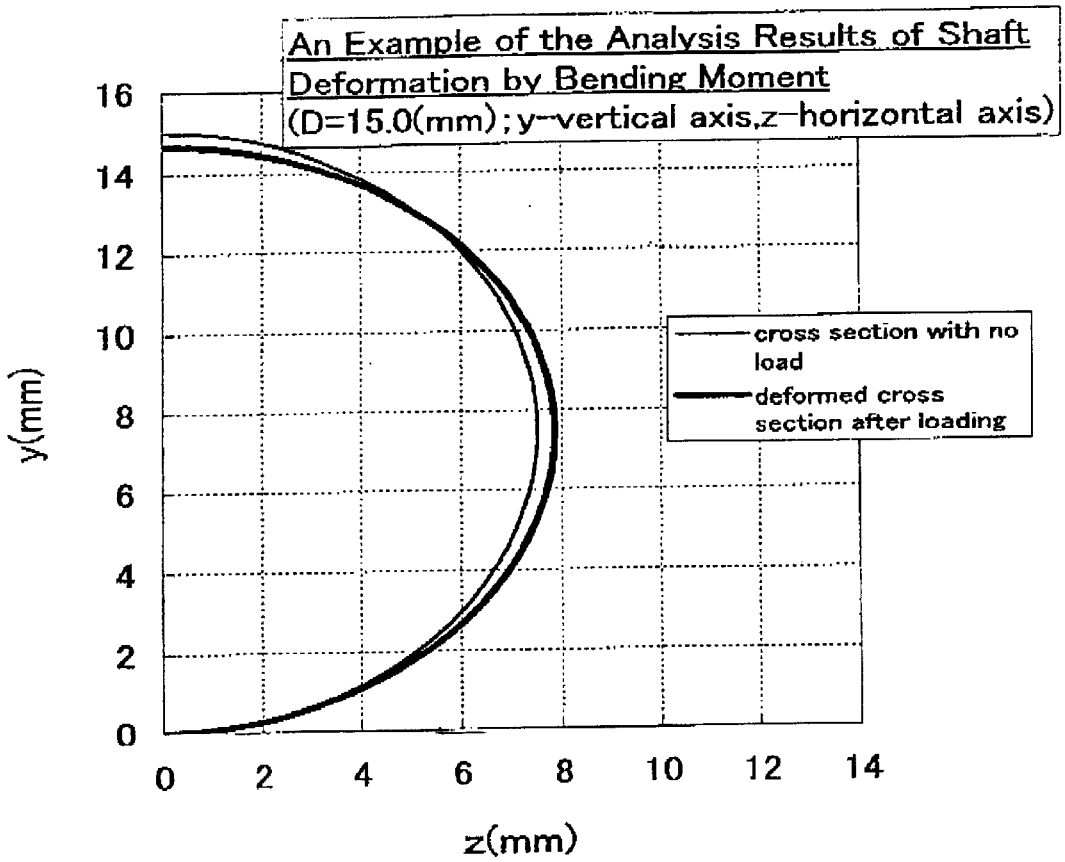
FIG. 3 is a graph showing an example of analysis results of deformation of the shaft cross section caused by bending moment.

The coordinate (z, y) of $\theta+d\theta$ at the sector $-\pi/2 \leqq \theta \leqq +\pi/2$ was calculated with $z=r\cdot\cos\theta$ and $y=r\cdot\sin\theta$. The $\theta+d\theta'$ and coordinate (z, y)=(z+dz', y+dy') after deformation were calculated for the micro sector dθ' after deformation. The gradient at z=0 was set zero as a boundary condition for integrating the quantity of deformation at the sector $-\pi/2 \leqq \theta \leqq +\pi/2$. In other words, the gradient between the points (z, y)=(0, −r) and (z, y)=(0, +r) was set zero. An example of the analysis results of the coordinate (z, y) is shown in FIG. 3.

The graph shows the degree of the deformation of the shaft's traverse cross section when the model shaft has the external diameter D=15.0 (15 mm), Poisson's ratio ν=0.3, and longitudinal strain εx=0.1. In this model shaft, it is shown that the external diameter of the shaft after receiving bending moment is reduced at the upper side of the shaft in the y coordinate or perpendicular direction and expanded in the z coordinate or horizontal direction, when compared with the external diameter of the shaft with no load. Thus, the deformation of the cross section of various shafts with different external diameters D, Poisson's ratios ν, and longitudinal strains εx when receiving load may be simulated by measuring the external diameter D, Poisson's ratio ν, and longitudinal strain εx in advance.

Figure 4A:
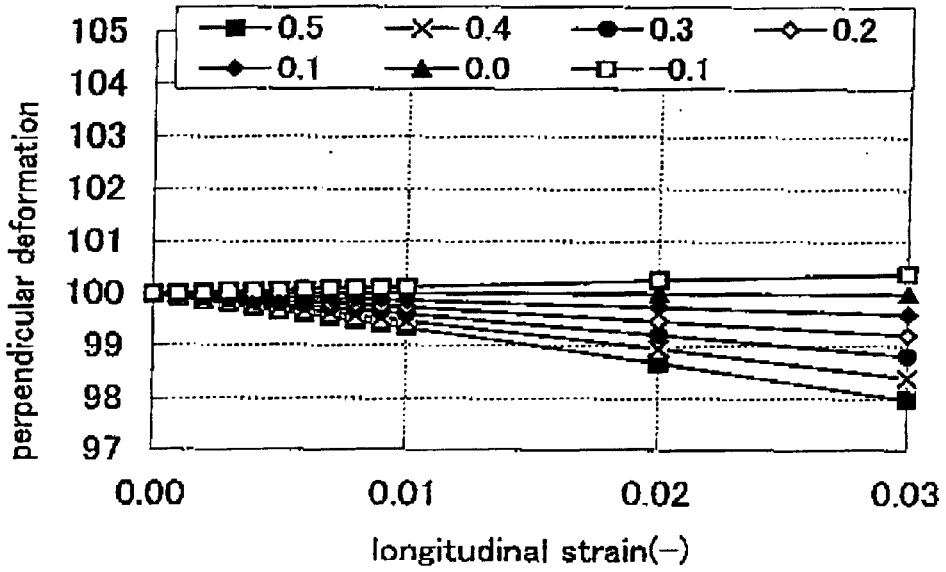
FIG. 4A shows the ratio (%) of the external diameter D perpendicular to the neutral plane N and FIG. 4B shows the ratio (%) of external diameter D horizontal to the neutral plane N (in z-axis direction in FIG. 2B).
Figure 4B:
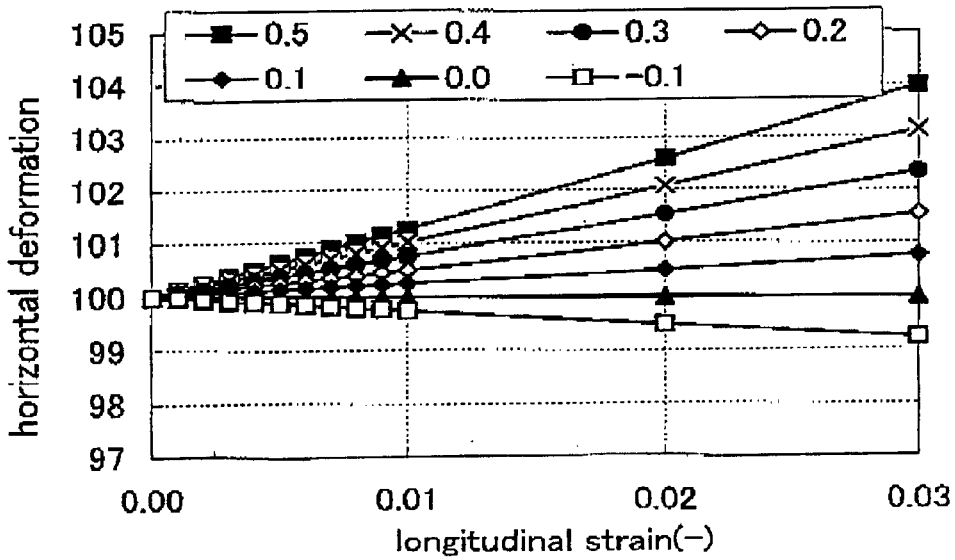

FIGS. 4A and 4B are graphs showing the degree of deformation of contour of the shafts with different Poisson's ratios ν when bending moment is applied to the respective shafts. The values of −0.1 to +0.5 in the square in FIGS. 4A and 4B are the Poisson's ratio ν. The axis of abscissa of the graph shows the longitudinal strain εx, while the axis of ordinate is the ratio (%) of the external diameter D of the shaft after receiving the bending moment to the external diameter D of the shaft with no bending moment set as 100. FIG. 4A shows the ratio (%) of the external diameter D in the direction perpendicular to the neutral plane N (or y-axis direction in FIG. 2B), and FIG. 4B shows the ratio (%) of external diameter D in the direction horizontal to the neutral plane N (z-axis direction in FIG. 2B). Since the shaft is not deformed with the bending moment in the circumferential direction when the Poisson's ratio ν is zero, the deformation ratio of the external diameter of the shaft remains 100.

The results shown in FIGS. 4A and 4B revealed that the longitudinal strains εx and the degree of deformation of the contour of the shaft have generally linear relationship, and that the shaft with greater Poisson's ratio ν had the greater degree of deformation of the contour. Therefore, it has been shown that the longitudinal strains εx caused by bending moment in the longitudinal direction of the shaft and the deformation of the contour of the shaft have a substantially linear relationship, and that the Poisson's ratio ν (when the strain in the longitudinal direction of the shaft is set as the longitudinal strains εx) has a substantially linear relationship with the deformation of the contour of the shaft.

Thus, the deformation of the external diameter A, or the degree of collapse or flattening of the shaft's cross section, at a certain position in the longitudinal direction of the shaft may be evaluated by measuring the Poisson's ratio ν at the position. The higher Poisson's ratio ν means greater degree of deformation of the shaft's cross section, while the lower Poisson's ratio ν means lower degree of deformation of the shaft's cross section. Thus the performance against the deformation of the shaft's cross section may be evaluated by measuring the Poisson's ratio ν at a certain position on the actual Shaft.

Our investigation on the Poisson's ratios ν of various golf club shafts showed that conventional metal shafts have relatively low Poisson's ratio ν of approximately 0.3 but that FRP shafts have Poisson's ratio ν of 0.6 to 0.8, which is nearly twice that of the metal shafts. Therefore, the shaft's cross section is more greatly collapsed or flattened in FRP shafts than in metal shafts. This may sometimes affect the swing or feeling of the club that golfers perceive. Professional golfers, who have used metal shafts to improve their swings, tend to avoid a club with FRP shafts, since FRP shafts have significantly different performance and feeling from golf clubs with metal shafts. One of the reasons lies in misfit feelings originating from deformation of the FRP shafts. A research was conducted on a club shaft having feelings preferred by professional golfers and revealed that such a club shaft has the Poisson's ratio ν of 0.5 or less on at least a portion, more preferably a portion on a grip side, in the longitudinal direction of the shaft. Therefore, FRP shafts with the Poisson's ratio ν as low as metal shafts are expected to be lightweight shafts with excellent feelings during a swing. Thus, the construction of FRP shafts with low Poisson's ratio ν was studied.

Although the shaft in accordance with the present invention may be any of S/R shaft, FW shaft, and braided shaft, FW shaft and braided shaft are preferable since no joints of circumferential direction extend in the axial direction on the shaft. An example of the braided shaft is now explained. To fabricate the braided shaft, braid yarns called tow prepregs made of reinforcing fibers impregnated with resin are wound around a mandrel.

Figure 5B:
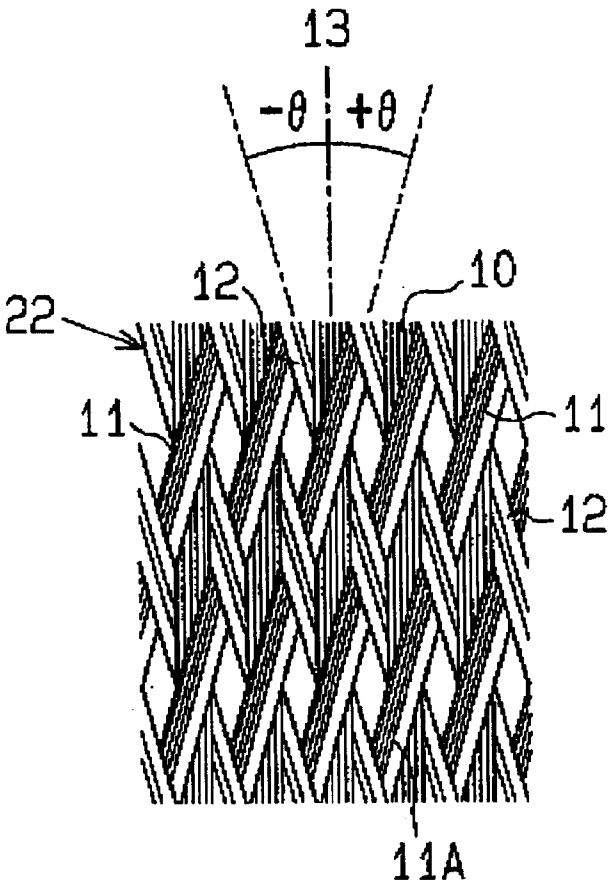
FIGS. 5A and 5B are schematic diagrams showing embodiments of the braided layer of the braided shaft in accordance with the present invention.
Figure 5A:
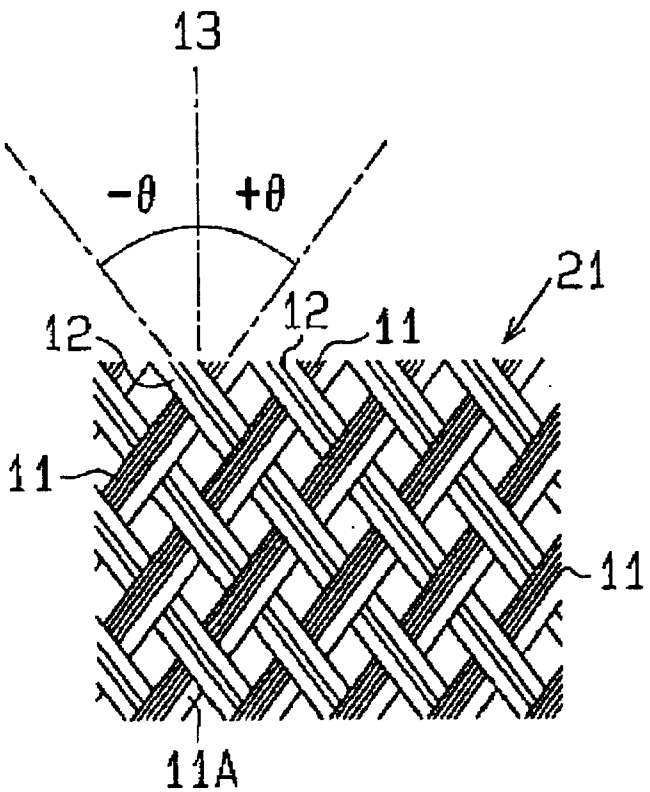

FIGS. 5A and 5B shows a preferred embodiment of the braided layer of the braided shaft in accordance with the present invention. A braided layer 21 in FIG. 5A is constructed by braiding two-directional diagonal yarns 11 and 12, which are respectively angled at orientation angles +θ and −θ against the longitudinal axis 13 of the shaft and disposed substantially symmetrically, while a braided layer 22 in FIG. 5B is constructed by braiding the diagonal yarns 11 and 12 respectively angled at orientation angles +θ and −θ against the longitudinal axis 13 of the shaft and warps 10 angled at approximately 0° against the longitudinal axis 13 of the shaft. Orientation angles +θ and −θ of the two-directional diagonal yarns 11 and 12 preferably range from more than 0° to +10° and from less than −0° to −10° respectively, and/or from 45° to less than +90° and from −45° to more than −90° respectively, along substantially the entire length of the shaft 2. More preferably, the angles +θ and −θ range from more than 0° to +5° and from less than −0° to −5° respectively, and/or from 50° to less than +90° and from −50° to more than −90° respectively, along substantially the entire length of the shaft 2. That is, orientation angles except for from greater than 10° to less than 45° and from less than −10 to greater than −45° contribute to the reduction of Poisson's ratio.

The braided layer 22 in FIG. 58 include the warps 10 angled at approximately 0°, which also contributes to the reduction of Poisson's ratio. The provision of the triaxial braided layer 22 as an outer layer facilitates the arrangement of the shaft rigidity and improves the shaft strength.

In FIG. 5A, the diagonal yarns 11A and 12 intersect with other yarns in a pattern such that the diagonal yarns 11 passes above, below, above, below, and so forth with respect of the other yarns. In FIG. 5B, the diagonal yarn 11A intersects with the warps 10 and diagonal yarns 12 in a pattern such that the diagonal yarn 11A passes above, above, below, above, above, below, and so forth with relative to the warps 10 and diagonal yarns 12 from the top to the bottom of the figure. The diagonal yarn 12 intersects with the warps 10 and the diagonal yarns 11 in a pattern such that the diagonal yarn 12 passes below, below, above, below, below, above, and so forth with relative to the warps 10 and the diagonal yarns 11 from the top to the bottom of the figure.

The braided layers 21 and 22 cover over the circumference of the shaft 2 and also extend the substantially entire length of the shaft 2 in its longitudinal direction. In the braided shaft constructed by laminating a plurality of braided layers, the braided layers 21 and 22 may be provided at any given position in the radial direction of the shaft. However, they are preferably provided as inner layers close to the shaft axis. One or more of the braided layers 21 and 22 may be provided. The thickness of the braided layers 21 and 22 in the radial direction of the shaft is preferably two thirds or more of the total thickness of the shaft, and more preferably three fourths or more of the same. Since a plurality of yarns are interwoven in the braided shaft, the shaft is superior in bending strength, twist and flexural rigidity and also favorable in terms of appearance with a fewer irregularities on its surface The portion with Poisson's ratio ν of 0.5 or less may be located at any given position on the longitudinal direction of the shaft. The portion may extend along a part of or entire the shaft. Preferably the position is provided on the grip side, where great bending moment is applied during a swing The decrease Poisson's ratio ν on the grip side effectively suppresses the deformation of the shaft's cross section, thus improving maneuverability of the shaft by golfers. In one embodiment, the portion with the Poisson's ratio ν of 0.5 or less includes the part extending over one third of the shaft length from the shaft butt end 4 on the grip side, In another embodiment, the external diameter of the portion with the Poisson's ratio ν of 0.5 or less is larger than the half of the sum of the external diameter of the shaft tip end 3 and that of the shaft butt end 4.

While the Poisson's ratio ν of 0,5 or less is effective to prevent collapse or flattening of the shaft contour, the Poisson's ratio ν is preferable 0.3 or more. Actually, when a golf club shaft with the Poisson's ratio ν loss than 0.3 was designed and manufactured, the shaft did not a minimum rigidity, strength, and performance as a golf club shaft. Accordingly, the Poisson's ratio ν ranging from 0.3 or more to 0.5 or less is preferred.

The present invention also includes the method for evaluating the shaft performance against deformation of the shaft's cross section based on the measurement of the Poisson's ratio. In that case, the strain in the longitudinal direction of the shaft is designated as a longitudinal strain and the strain in the circumferential direction of the shaft is designated as a lateral strain when load is applied to the shaft. The Poisson's ratio is expressed as a ratio of the longitudinal strain to the lateral strain. The Poisson's ratio is measured at a certain position in the longitudinal direction of the shaft. The load includes tensile load applied in the longitudinal direction of the shaft as well as the bending moment. The Poisson's ratio when the tensile load is applied, as the Poisson's ratio when the bending moment is applied, may also be used for evaluating the shaft performance against deformation of the shaft's cross section. This evaluation method for shafts will contribute to efficient fabrication and selection of shafts that has decreased deformation of the cross section and that is easily swung.

EXAMPLES

Inventive shafts which embody the above description and conventional shafts are now described below.

In order to measure Poisson's ratios ν of commercially available golf club shafts, a biaxial orthogonal strain gauge (manufactured by Kyowa Electronic Instruments Co. Ltd.) was used. The shafts in accordance with the present invention and the shafts of commercially available golf clubs were tested. The strain gauges were attached along the shaft circumference orthogonal to the longitudinal axis of the shaft. The strain gauges were attached at the positions 150 mm, 400 mm, and 700 mm (plus 1000 mm in case of shaft for a wood club) from the shaft tip end in the longitudinal direction. Then the longitudinal and lateral strains were measured at respective positions when static bending moment was applied to the shaft against its longitudinal axis for obtaining the Poisson's ratios ν.

The materials of the measured shafts are described below.

Shafts of Commercially Available Golf Clubs

Conventional shaft 1: A metal shaft for the iron. The metal material used is chrome molybdenum steel, which is isotropic material, with the shaft weight of approximately 120 g.

Conventional shafts 2–1, 2–2, 2–3, 2–4: FRP S/R shafts for the iron. The conventional shaft 2–1 has the weight of approximately 90 g.

Conventional shaft 3: An FRP FW shaft for the wood. The shaft has the weight of approximately 100 g.

Shafts in Accordance With the Present Invention

Embodiment 1: An FRP braided shaft for the iron. The shaft comprises two inner layers and one outer layer on the inner layers. Each of the inner layers includes eight sets of diagonal yarns in two directions braided at the orientation angle of +42° to +56°, and −42° to −56°, respectively from the shaft tip end of to the butt end (991 mm from the tip end). The outer layer includes eight sets of diagonal yarns in two directions braided at the orientation angle of +16° to +26°, and −16° to −26°, respectively, and eight warps placed at the orientation angle of 0° from the tip end of to the butt end. At the position approximately 700 mm from the tip end which is measured with the strain gauges, the thickness of the braided layers with diagonal yarns placed at the orientation angle of approximately +45° to +56°, and approximately −45° to −56° occupies approximately 67%, i.e. two of the three layers, of the entire thickness of the shaft. The shaft has the weight of approximately 90 g.

Embodiment 2: An FRP braided shaft for the wood. The shaft comprises two first inner layers, one second inner layer on the first inner layers, and one outer layer on the second inner layer. Each of the first inner layers includes eight sets of diagonal yarn in two directions braided at the orientation angle of +38° to +50°, and −38° to −50°, respectively from the shaft tip end of to the butt end (1143 mm from the tip end), The second inner layer include eight sets of eight diagonal yarns in two directions braided at the orientation angle of +41° to +55° and −41° to −55° respectively from the shaft tip end of to the butt end (1143 mm from the tip end). The outer layer includes eight sets of diagonal yarns in two directions braided at orientation angle of +7° to +19° and −7° to −19°, respectively, and eight warps placed at the orientation angle of 0° from the tip end to the butt end. At the position on approximately 700 to 1000 mm from the tip end which is measured with the strain gauges, the total thickness of the braided layers with diagonal yarns placed at the orientation angle of approximately +45° to +55° and −45° to −55° and approximately +7° to +10° and −7° to −10° occupies approximately 75% of the entire thickness. The shaft has the weight of approximately 100 g.

The measured Poisson's ratios ν of the respective shafts are shown in Table 1.

TABLE 1

The Poisson's ratios ν of conventional shafts and shafts in accordance with the present invention

| Distance from tip (mm) | Conventional shaft 1 | Conventional shaft 2-1 | Conventional shaft 2-2 | Conventional shaft 2-3 |
|---|---|---|---|---|
| 150 | 0.31 | 0.79 | NA | NA |
| 400 | 0.32 | 0.77 | NA | NA |
| 700 | 0.32 | 0.66 | 0.67 | 0.64 |
| 1000 | — | — | — | — |

| Distance from tip (mm) | Conventional shaft 2-4 | Conventional shaft 3 | Embodiment 1 | Embodiment 2 |
|---|---|---|---|---|
| 150 | NA | 0.50 | 0.58 | 0.62 |
| 400 | NA | 0.54 | 0.49 | 0.55 |
| 700 | 0.77 | 0.61 | 0.33 | 0.47 |
| 1000 | — | 0.55 | — | 0.40 |

While the metal shaft of the Conventional shaft 1 showed low Poisson's ratios ν of approximately 0.3 at each measurement point, the FRP shafts of conventional shafts 2–1 through 2–9 and 3 showed Poisson's ratios ν higher than 0.5 at each measurement point. Embodiments 1 and 2 of the present invention, which have the construction of braided layers of diagonal yarns oriented from 45° to less than +90° and from −45° to more than −90° as mentioned above, showed Poisson's ratios ν lower than 0.5 at approximately 700 mm and 700 mm and 1000 mm, respectively, from the tip end of the shaft.

Figure 6:
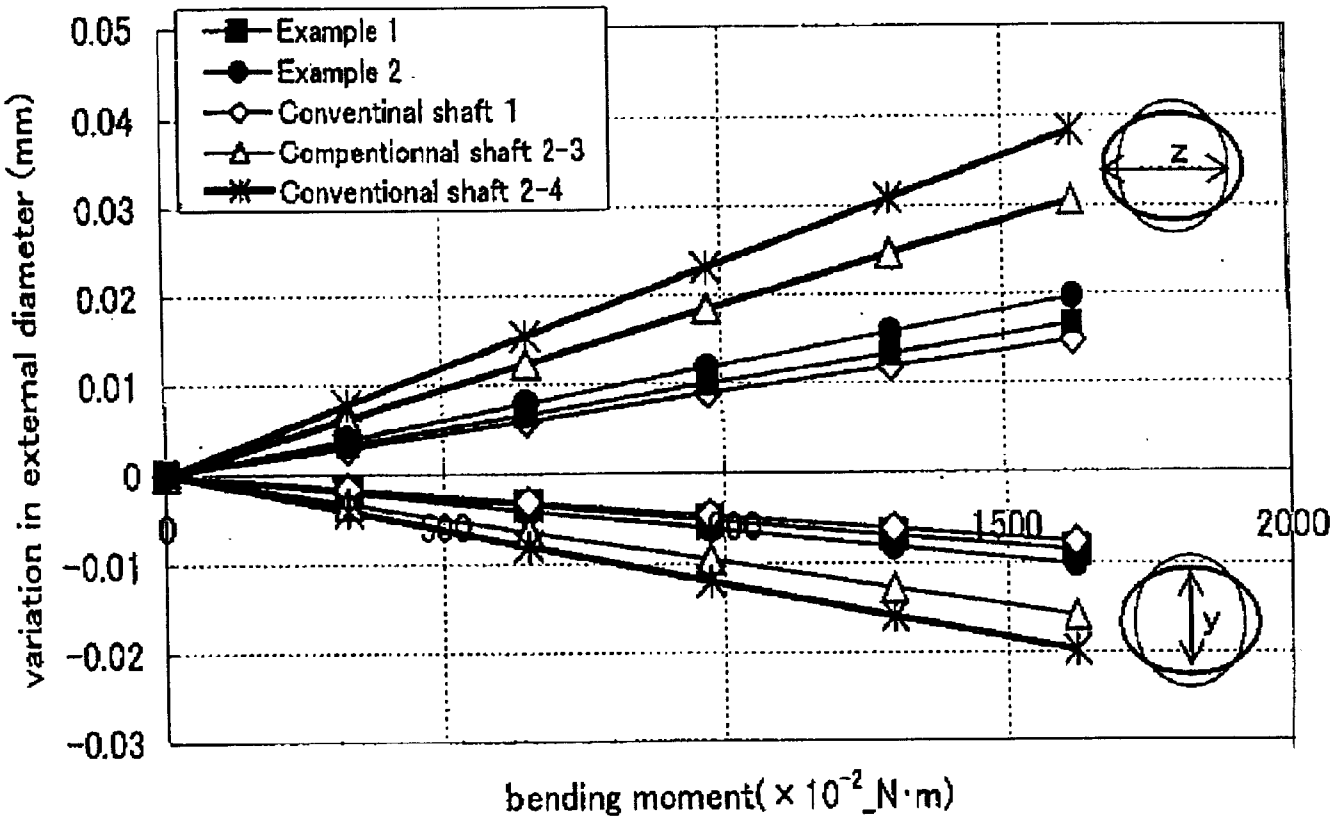
FIG. 6 is a graph showing variation of the external diameter both horizontal and perpendicular to the bending moment of the shafts in accordance with the present invention and the conventional shafts.

The bending moment and deformation of shafts' cross section were also examined. FIG. 6 is a graph showing variations in external diameters of the conventional shafts and shafts in accordance with the present invention to the bending moment applied in the longitudinal direction of the shaft. The upper part of the graph shows variations of the external diameters in the horizontal direction of the shaft, and the lower part of the graph shows those in the perpendicular direction.

As shown in this figure, the variation in the external diameter increases in virtually linear fashion along with the increase in the bending moment. Although great variation in the external diameter, or deformation, were observed in the conventional FRP shafts 2–3 and 2–4, the variation in the external diameter in the FRP shafts of Embodiments 1 and 2 remained low, as in the conventional metal shaft 1. Thus, it was confirmed that the shafts of Embodiments 1 and 2 have excellent rigidity against deformation of the shaft's cross section.

Professional male golfers, who have used a club with the shaft of conventional shaft 1, tried the iron clubs that include the shafts of the conventional shafts 1 and 2–1 and of Embodiment 1. As a result, the club with the shaft of Embodiment 1, which is lighter by 30 g than the Conventional shaft 1, was evaluated as being stable with for a long flying distance. The conventional shaft 2–1, in spite of having the same weight as the Embodiment 1, was evaluated as being unstable and with inconsistent trajectory. They also commented that they felt instability at swing change and could not grasp the head position.

Further, the golfers tried the wood clubs that include the shaft that is made of the same material as the conventional shaft 1 but that has the weight of approximately 120 g and shafts of the conventional shaft 3 and of Embodiment 2. As a result, the club with the shaft of Embodiment 2, which is lighter by 20 g than conventional shaft 1, was evaluated as being reliable, and stable for a long flight distance without misfit feelings in spite of its lightweight. The conventional shaft 3 having the same weight as the Embodiment 2 was evaluated as being unstable during a swing, causing misfit feelings.

It should be apparent to those skilled in the art that the present invention may be embodied in many other specific forms without departing from the spirit or scope of the invention. Particularly, it should be understood that the invention may be embodied in the following forms.

Although the braided layers 21 and 22 cover the entire circumference of the shaft 2 in the above embodiments, the braided layers 21 and 22 may cover only a part of the shaft 2 in the circumferential direction.

In the above embodiments, the orientation angles +θ and −θ of the diagonal yarns 11 and 12 preferably range from more than 0° to +10° and from less than −0° to −10° respectively, and/or from 45° to less than +90° and from −45° to more than −90° respectively, along substantially the entire length of the shaft 2. More preferably, the angles +θ and −θ range from more than 0° to +5° and from less than −0° to −5° respectively, and/or from 50° to less than +90° and from −50° to more than −90° respectively, along substantially the entire length of the shaft 2. However, it would be satisfactory as long as the diagonal yarns 11 and 12 fall within the above orientation angles for at least a part of the shaft 2 in the longitudinal direction.

Either or both of the braided layers 21 and 22 may be used for a shaft 2.

Figure 7A:
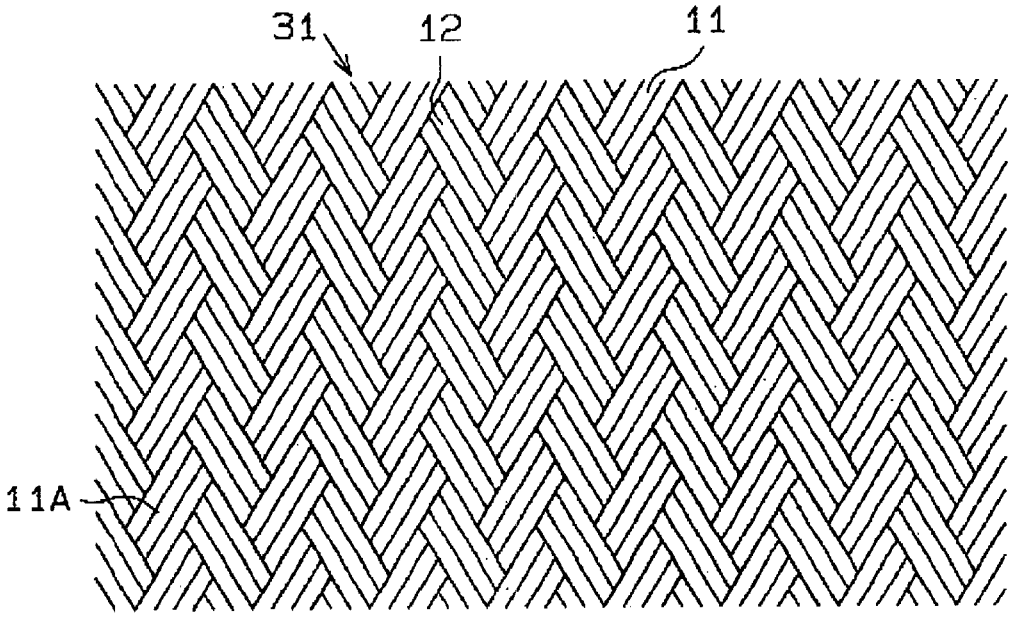
FIGS. 7A and 7B are schematic diagrams showing other embodiments of the braided layer of the braided shaft in accordance with the present invention.

The braided layer 21 having biaxial construction in FIG. 5A may be replaced with a braided layer 31 having biaxial construction as shown in FIG. 7A. In FIG. 7A, the diagonal yarns 11 and 12 have the same orientation angles as in FIG. 5A but the diagonal yarns 11A and 12 intersect with other yarns 11A and 12 in a pattern such that the yarns 11 and 12 pass above, above, below, below, above, above, below, below, and so forth with relative to the other diagonal yarns.

Figure 7B:
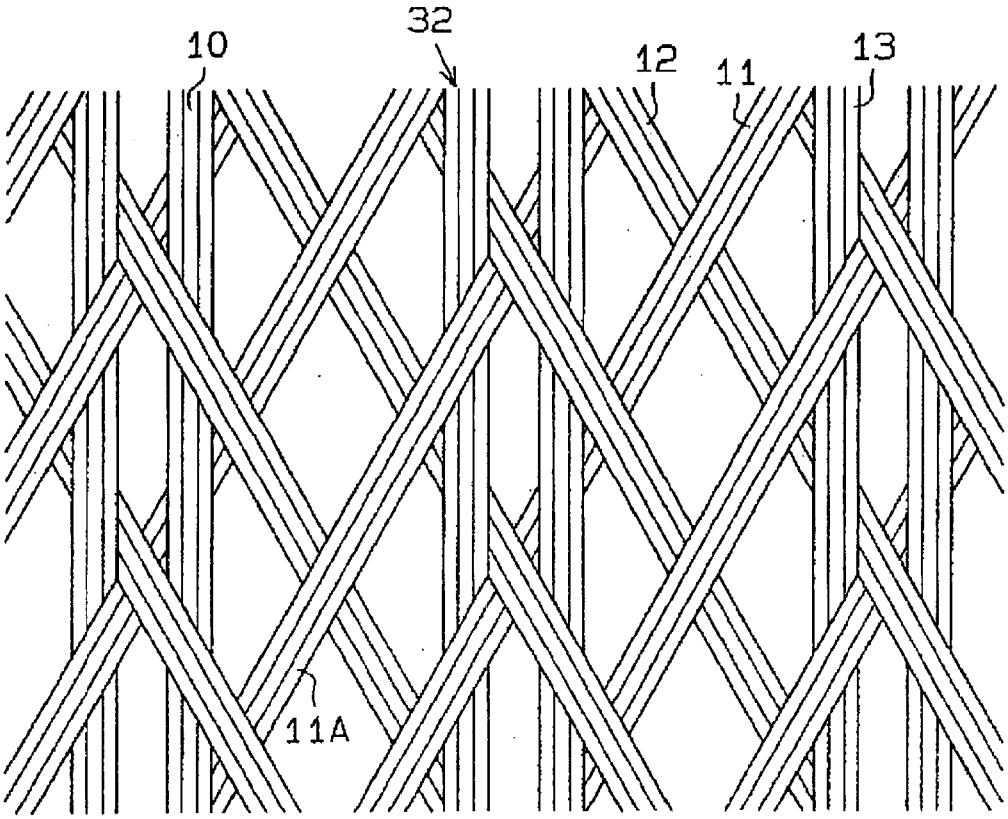

The braided layer 22 having triaxial construction in FIG. 5B may be replaced with a braided layer 32 having triaxial construction as shown in FIG. 7B. In FIG. 7B, the warp 10 and diagonal yarns 11 and 12 have the same orientation angles as in FIG. 53 but the diagonal yarn 11A intersects with the corresponding warps 10 and the corresponding diagonal yarns 12 in a pattern such that the yarn 11A pass below, below, below, above, above, above, below, below, below and so forth with relative to the corresponding warps 10 and the corresponding diagonal yarns 12 from the top to the bottom of the figure. The diagonal yarn 12 intersects with the warps 10 and diagonal yarns 11 in a pattern such that the diagonal yarn 12 passes above, above, above, below, below, below, above, above, above, and so forth from the top to the bottom of the figure.

In the braided layers 21, 22, 31, and 32 shown in FIGS. 5A, 5B, 7A, and 7B, the vertical relationship of intersections of the diagonal yarns 11 and 12 may be reversed. For example, the diagonal yarn 11A in FIG. 5B may take a pattern such that the diagonal yarn 11A passes below, below, above, below, below, above, and so forth, and the diagonal yarns 12 may take a pattern such that the diagonal yarns 12 pass above, above, below, above, above, below, and so forth (not shown).

The FW shaft may be used instead of the braided shaft. The diagonal yarns of the FW shaft are wound around the mandrel at the same orientation angles as in the braided shaft. The thickness of the diagonal yarns braided in the orientation angle in the shaft radial direction is preferably two thirds or more of the entire thickness of the shaft and, more preferably three fourths of the entire thickness of the shaft. The FW shaft is readily fabricated.

Therefore, the present examples and embodiments are to be considered as illustrative and not restrictive and the invention is not to be limited to the details given herein, but may be modified within the scope and equivalence of the appended claims.

I claim:

1. A golf club shaft made of fiber reinforced plastic comprising:

at least a portion along the longitudinal direction of the shaft which satisfies a Poisson's ratio of 0.5 or less, wherein the Poisson's ratio is expressed by the ratio of lateral strain to longitudinal strain, wherein the longitudinal strain is the strain in the longitudinal direction of the shaft and the lateral strain is the strain in the circumferential direction of the shaft when load is applied to the shaft.

2. A golf club shaft according to claim 1, wherein the Poisson's ratio is 0.3 or more at said portion.

3. A golf club shaft according to claim 1, wherein the shaft includes a braided layer of substantially symmetrical diagonal yarns which are positioned at orientation angles from more than 0° to −10° and from less than 0° to −10° respectively, and/or from 45° to less than +90° and from 45° to more than −90° respectively, against the longitudinal axis of the shaft at said portion.

4. A golf club shaft according to claim 3, wherein the shaft includes a plurality of braided layers and the braided layer is an inner layer.

5. A golf club shaft according to claim 4 further comprising an outer layer over the inner layer, wherein the outer layer is a triaxial braided layer that includes diagonal yarns and a warp that is oriented at approximately 0° along substantially the entire length of the shaft.

6. A golf club shaft according to claim 5, wherein the inner layer is a biaxial braided layer in which the orientation angles of the diagonal yarns range from +45° to less than +90° and from −45° to more than −90° respectively at said portion, wherein the outer layer is an triaxial braided layer in which the orientation angles of the diagonal yarns range from more than 0° to +10° and from less than −0° to −10° respectively at said portion.

7. A golf club shaft according to claim 3, wherein the thickness of the braided layer is two thirds or more of the entire thickness of the shaft.

8. A golf club shaft according to claim 7, wherein the thickness of the braided layer is three fourths or more of the entire thickness of the shaft.

9. A golf club shaft according to claim 1, wherein the shaft has a butt end to which a grip is attached, wherein said portion with the Poisson's ratio of 0.5 or less includes a one third portion of the shaft length from the butt end.

10. A golf club shaft according to claim 1, wherein the shaft has a tip end and a butt end, wherein the external diameter of said portion with the Poisson's ratio of 0.5 or less includes a portion that has an external diameter greater than the half of the sum of the external diameter o the shaft tip end and that of the shaft butt end.

11. A golf club shaft according to claim 1, wherein the shaft is made of carbon fiber reinforced fiber plastics.

12. A golf club shaft according to claim 1, wherein the shaft is a braided shaft.

13. A golf club shaft according to claim 1, wherein the shaft is an FW shaft.

14. A golf club comprising:

a golf club shaft having a tip end and a butt end, wherein the shaft is made of fiber reinforced plastic, wherein the shaft has at least a portion along the longitudinal direction of the shaft which satisfies a Poisson's ratio of 0.5 or less, wherein the Poisson's ratio is expressed by the ratio of lateral strain to longitudinal strain, wherein the longitudinal strain is the strain in the longitudinal direction of the shaft and the lateral strain is the strain in the circumferential direction of the shaft when load is applied to the shaft;

a head attached to the tip end of the shaft; and a grip attached to the butt end of the shaft.

15. A method for evaluating a golf club shaft comprising:

measuring the Poisson's ratio at a predetermined position along the longitudinal direction of the shaft, wherein the Poisson's ratio is expressed by the ratio of lateral strain to longitudinal strain, wherein the longitudinal strain is the strain in the longitudinal direction of the shaft and the lateral strain is the strain in the circumferential direction of the shaft when load is applied to the shaft; and evaluating the shaft performance against deformation of the shaft cross section based on the measured value.

* * * * *